United States Patent [19]

Sanborn et al.

[11] 4,316,502

[45] Feb. 23, 1982

[54] HELICALLY FLIGHTED HEAT EXCHANGER

[75] Inventors: David M. Sanborn, Roswell; Andrew L. Blackshaw, Dunwoody, both of Ga.

[73] Assignee: E-Tech, Inc., Atlanta, Ga.

[21] Appl. No.: 202,888

[22] Filed: Nov. 3, 1980

[51] Int. Cl.[3] ..... F28D 7/02

[52] U.S. Cl. ..... 165/140; 165/164

[58] Field of Search ..... 165/46, 169, 156, 164, 165/140, 168

[56] References Cited

U.S. PATENT DOCUMENTS

| | | | |
|---|---|---|---|
| 2,324,707 | 7/1943 | Johnson | 165/164 X |
| 2,681,797 | 6/1954 | Van Vliet | 165/164 X |
| 2,721,061 | 10/1955 | Freer | 165/169 X |
| 3,163,996 | 1/1965 | Koch | 165/169 X |
| 3,739,842 | 6/1973 | Whalen | 165/169 X |
| 4,061,184 | 12/1977 | Radcliffe | 165/169 X |
| 4,196,772 | 4/1980 | Adamski et al. | 165/169 X |

FOREIGN PATENT DOCUMENTS 2441664 3/1976 Fed. Rep. of Germany ..... 165/169

*Primary Examiner*—Sheldon J. Richter
*Attorney, Agent, or Firm*—B. J. Powell

[57] ABSTRACT

A heat exchanger including a first piece of heat conductive tubing wound in a helical configuration defining a plurality of first helical flights having an outboard portion thereon and a second piece of heat conductive tubing wound in a helical configuration defining a plurality of second helical flights having an inboard portion thereon where the first and second helical flights are arranged so that the outboard portions of the first helical flights are in heat conducting contact with the inboard portions of the second helical flights and where the first and second helical flights have been formed by forcing the outboard portions of the first helical flights and the inboard portions of the second helical flights together so that the portions are forced into heat conducting contact with each other. The disclosure also describes the method of manufacturing the heat exchanger and the method of operating the heat exchanger.

8 Claims, 9 Drawing Figures

HELICALLY FLIGHTED HEAT EXCHANGER

BACKGROUND OF THE INVENTION

Heat transfer coils find many uses today to transfer heat from one fluid to another. In instances where both fluids between which heat is to be transferred need to be confined, heat transfer coils consist generally of one or more tubes through which one of the fluids is passed with the first mentioned tube being enclosed in another tube so that the other liquid passes between the first mentioned tube or tubes and the second mentioned tube. One of the primary problems with this type of heat transfer coil construction is that, once the size of the first mentioned tube is selected, the area through which the heat is transferred from one of the fluids to the other fluid is typically fixed unless one goes to expensive fabrication techniques and uses excessive materials in order to place fins on the tubes carrying the first mentioned fluid. Another problem encountered with this type of prior art heat transfer coil is that it is difficult to form such heat transfer coils in a coil configuration in which both the first mentioned tube or tubes and the second mentioned tubes are curved since it is difficult to maintain the concentricity between the tubes resulting in a varying heat transfer efficiency between the fluids.

In some cases, such as those in which heat is to be transferred to or from potable water, safety code regulations require a double wall between the fluids in a heat transfer relationship with each other. This is the case when condenser heat from refrigeration, air conditioning or heat pump systems is used to heat potable hot water. In order to place a double wall between the refrigerant and the potable water being heated, the prior art, as best illustrated in U.S. Pat. Nos. 3,922,876 and 4,173,872 has attempted to solve this problem by sheathing the tube carrying the refrigerant in an extra tube so that three, rather than two, tubes are used in the coil. In such coils, the potable water typically passes through the innermost tube while the refrigerant passes between the outermost tube and the middle tube. The space between the innermost tube and the middle tube is typically filled with a heat conducting medium in an attempt to provide good heat transfer between the refrigerant and the potable water. This type of prior art heat transfer coil suffers from several drawbacks. One of these drawbacks is that such heat transfer coil is difficult and expensive to fabricate. Another drawback is that it is difficult to maintain a good heat transfer rate between the refrigerant and the potable water. Yet another drawback is that this type of heat transfer coil requires the use of at least three tubes to transfer heat between two fluids and, as such, uses an excessive amount of tubing material and produces a heavy coil. Still another drawback is that this type of coil requires soldered or mechanical joints at the tube ends.

SUMMARY OF THE INVENTION

These and other problems associated with the prior art are overcome by the invention disclosed herein by providing a heat transfer coil which can be economically manufactured, which provides a double wall separation between the refrigerant and the liquid between which heat is being transferred, and which provides good heat transfer. The invention further provides a heat transfer coil in which the passages therethrough can be adjusted in cross-sectional size to selectively control the velocity of the fluid medium passing therethrough and the pressure drop along the length of the coil. The invention also permits the surface area of the passages through the coil to be chosen substantially independently of the cross-sectional flow area in order to maximize the fluid to surface heat transfer co-efficient. By having separate tubes forming the fluid passages through the coil, the tubes making up the coil can be substantially independently adjusted to the heat transfer requirements of each fluid.

The method of the invention includes simultaneously winding the first and second pieces of tubing around a core to form coils where the coils are wound so that the flights of both coils lie generally in the same radial plane around the core and where each of the pieces of the tubing is deformed into a non-circular shape and at least one of the pieces of the tubing has a deformed cross-sectional area smaller than the desired cross-sectional area the tubing is to have when the heat exchanger is completed; and, then, internally pressurizing at least the piece of tubing having the deformed cross-sectional area smaller than the desired cross-sectional area while the coils are maintained in the helical configuration to reform both pieces of tubing while increasing the cross-sectional area of the piece of tubing having the smaller deformed cross-sectional area so that the desired cross-sectional areas are achieved in the coils. The pieces of tubing are selected so that the ratio of the cross-sectional peripheral surface of the pieces of tubing with respect to each other is within about 90–100% of the square root ratio of the convective heat transfer coefficients of the fluids flowing through the two pieces of tubing. The internal pressurization of the pieces of tubing in the coil forces the pieces of tubing into physical contact with each other so that, after the pressure is removed, the natural resiliency of the pieces of tubing maintain the physical contact between the pieces of tubing. The method also includes injecting a heat transfer material between the juxtaposed portions of the pieces of tubing as the pieces of tubing are wound around the core so that the heat transfer material serves as a lubricant during the reforming operation by internally pressurizing the pieces of tubing. The method also contemplates simultaneously as well as sequentially internally pressurizing the pieces of tubing to form the coils.

The heat exchanger of the invention includes a first piece of heat conductive tubing wound in a helical configuration defining a plurality of first helical flights having an outboard portion thereon and a second piece of heat conductive tubing wound in a helical configuration defining a plurality of second helical flights having an inboard portion thereon where the first and second helical flights are arranged so that the outboard portions of the first helical flights are in heat conducting contact with the inboard portions of the second helical flights and where the first and second helical flights have been formed by forcing the outboard portions of the first helical flights and the inboard portions of the second helical flight together so that the portions are forced into heat conducting contact with each other. The heat exchanger of the invention contemplates the inboard and outboard portions of the helical flights being forced into heat conducting contact with each other by internally pressurizing at least one of the pieces of heat conductive tubing.

The invention also contemplates a method of operating a heat transfer coil having first and second pieces of heat conductive tubing wound in a helical configuration so that the outermost helical flights have an inboard portion in heat conducting contact with an outboard portion on the innermost helical flights comprising the steps of forcing a colder fluid through the piece of tubing forming the inner flights and forcing a hotter fluid through the piece of tubing forming the outer flights so that the centrifugal forces acting on the colder fluid forces the colder portions of the colder fluid toward the outboard portions of the innermost flight while the centrifugal forces acting on the hotter fluid forces the hotter portion thereof toward the inboard portions of the outermost flights to enhance the heat transfer between the fluids.

These and other features and advantages of the invention will become more clearly understood upon consideration of the following specification and accompanying drawings wherein like characters of reference designate corresponding parts throughout the several views and in which:

These figures and the following detailed description describe specific embodiments of the invention; however, it is to be understood that the inventive concept is not limited thereto since it may be embodied in other forms.

DETAILED DESCRIPTION OF ILLUSTRATIVE EMBODIMENTS

Finished Coil Description

Figure 1:
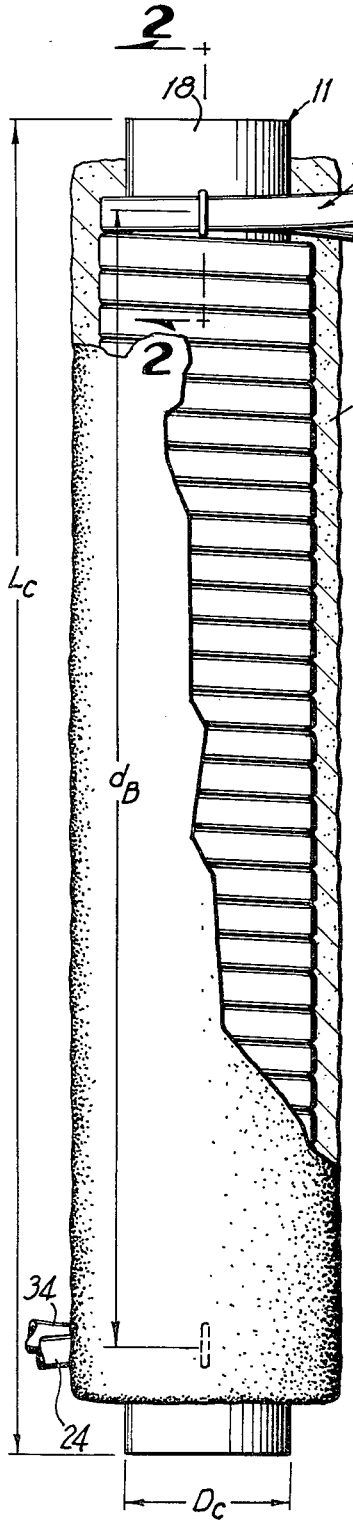
FIG. 1 is a side elevational view of a heat transfer coil embodying the invention.
Figure 2:
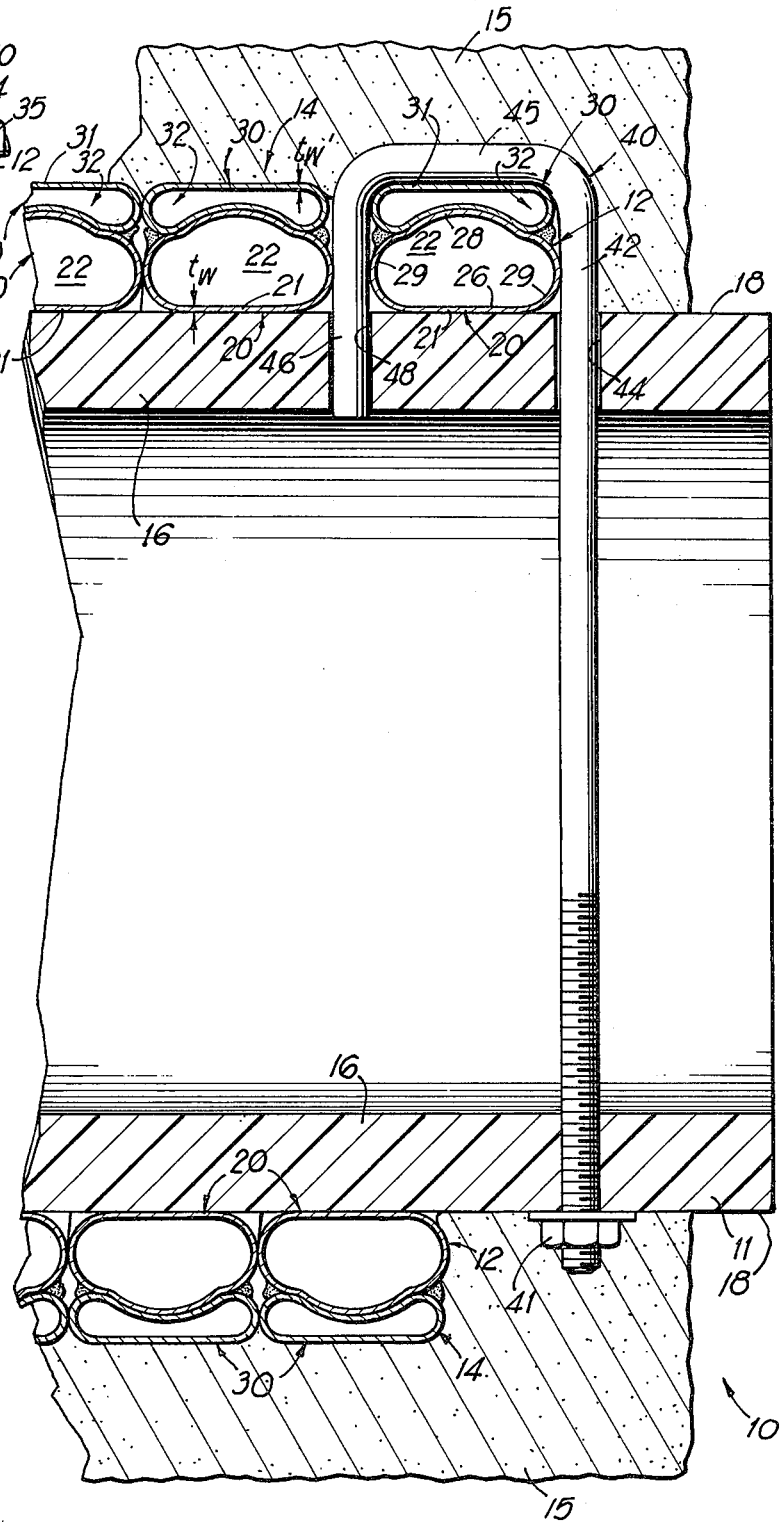
FIG. 2 is an enlarged cross-sectional view taken generally along line 2—2 in FIG. 1.

The completed heat transfer coil assembly 10 is best seen in FIGS. 1 and 2 and includes a core 11, an inner coil 12, an outer coil 14 and an insulating covering 15. The fluid to be cooled is passed through one of the coils while the fluid to be heated is passed through the other coil so that heat is transferred between the fluids. Typically, the fluid to be cooled is passed through the outer coil 14 as will become more apparent.

The core 11 serves to support the coils 12 and 14 while they are being formed as will become more apparent. Core 11 also serves to insulate the inside of the coil assembly 10. The core 11 is a cylindrical tubular member with an annular side wall 16 having a length $L_C$ longer than the lengths of coils 12 and 14 and has an outside surface 18 of diameter $D_C$ illustrated at about three inches. The particular core 11 illustrated is a section of polyvinyl chloride pipe with a nominal two and one-half inch inside diameter. By using this material, the strength of core 11 is sufficient to support the coils 12 and 14 while they are being formed and no additional insulation is required on the inside of the coils 12 and 14.

The inner coil is helically wound around the core 11 in a plurality of integrally connected helical flights 20 so that the inside of the flights 20 are supported on the outside cylindrical surface 18 of core 11. The coil 12 is made out of a deformable material such as copper with a tube wall 21 of thickness $t_w$ (FIGS. 2 and 3) so that the coil 12 can be formed as hereinafter disclosed. Coil 12 defines a fluid passage 22 therethrough with a prescribed cross-sectional area as will become more apparent. Opposite ends 24 and 25 of coil 12 are connected to a fluid circulation system to circulate the fluid through the passage 22.

The outer coil 14 is helically wound around inner coil 12 in a plurality of integrally connected helical flights 30 so that each flight 30 overlies one of the flights 20 on the inner coil 12. Thus, it will be seen that the outer coil 14 is supported on the inner coil 12. The coil 14 is also made out of a deformable material such as copper with a tube wall 31 of thickness $t_w'$ so that coil 14 can be formed as hereinafter disclosed. Coil 14 defines a fluid passage 32 therethrough with a prescribed cross-sectional area as will become more apparent. The opposite ends 34 and 35 of the coil 14 are connected to another fluid circulation system to circulate another fluid through the passage 32 so that heat will be transferred between the fluids.

The coils 12 and 14 are secured to the core 11 at their opposite ends by J-bolts 40 provided with nuts 41. The shank 42 of each of the J-bolts 40 extends diametrically through core 11 through appropriate diametrically opposed holes 44 through the side wall 16 of core 11 with the hook end 45 on the bolt extending over the outside of the endmost flight 30 on the outer coil 14 with a tip 46 that extends into a secondary hole 48 in side wall 16. The shank 42 extends past the endmost flight 20 on the inner coil 12 so that, when the nut 41 is screwed onto the threaded end of the shank 42 projecting through the hole 44 in the side wall 16 opposite the first mentioned hole 44 and tightened, the hook end 45 clamps the endmost flights 30 and 20 of coils 14 and 12 respectively tightly against the core 11 while the shank 42 and tip 46 prevent the flight 20 on coil 12 from slipping out from under flight 30 on coil 14. The distance $d_B$ axially along core 11 between bolts 40 is such that the flights 20 of inner coil 12 are held in a position underlying the flights 30 of outer coil 14 as will become more apparent so that the flights 20 remain centered under flights 30. Because the tip 46 on the hook end 45 is held in the secondary hole 48 in core 11, the shank 45 is prevented from bending such that the coils can slip from under the hook end 45.

Figure 3:
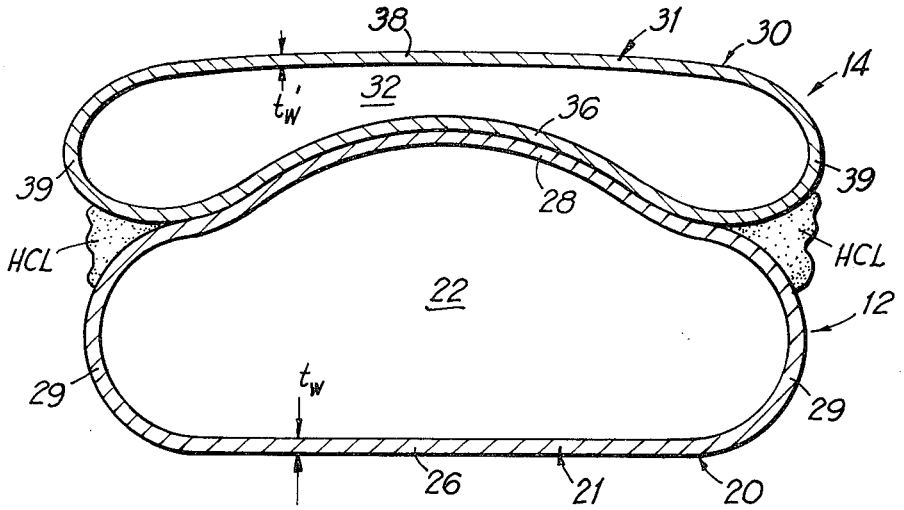
FIG. 3 is an enlarged cross-sectional view of one of the flights of each of the coils taken as in FIG. 2.

Referring more specifically to FIG. 3, it will be seen that the tube wall 21 of the inner coil 12 when viewed in cross-section, has a straight inboard section 26 along the inside of coil 12; a curved outboard section 28 along the outside of coil 12; and a pair of curved side sections 29 joining the inboard section 26 and the outboard section 28. The tube wall 31 of the outer coil 14, when viewed in cross-section, has a curved inboard section 36 along the inside of coil 14, a curved outboard section 38 along the outside of coil 14; and a pair of curved side sections 39 joining the inboard section 36 and the outboard section 38. It will be seen that the curved outboard section 28 of the inner coil 12 lies in heat conductive juxtaposition with the curved inboard section 36 of the outer coil 14.

Theoretical Considerations

The performance of a heat exchanger is typically expressed in terms of the rate of heat transferred from one fluid to another and represented by $$Q = UA\,(\Delta T_{lmtd}) \tag{1}$$

where:

Q=total heat transfer rate (Btu/hr)
U=overall heat transfer coefficient (Btu/hr.ft.$^2$F.)
A=mean effective heat transfer surface area (ft.$^2$)
$\Delta T_{lmtd}$=log mean temperature difference between fluids (F.)

Typically, the log mean temperature difference between the heat transfer fluids is established by external parameters. Thus, the performance of a heat exchanger is determined by the value UA where 1/UA is a measure of the overall heat transfer resistance of the heat exchanger commonly referred to as R. The merit of a heat exchanger is usually defined by its cost (manufacturing and operating) per unit of UA. It is almost always desirable to maximize the value of UA at any given cost. This usually permits the cost of the heat exchanger to be minimized.

In a conventional tube in a tube (bicentric) heat exchanger where heat is transferred between two fluids separated by a single solid wall, the value of UA is set by:

$$UA = \frac{1}{\frac{1}{h_1A_1} + \frac{t_w}{k_wA_w} + \frac{1}{h_2A_2}} \tag{2}$$

where:

h=convective heat transfer coefficient (Btu/hr.ft$^2$F.)
k=tube wall thermal conductivity coefficient (Btu/hr.ft.$^2$F.)
A=heat transfer area (ft.$^2$)
t=thickness (ft.)

and the subscripts are:

1=first fluid side
2=second fluid side
w=wall material

It is understood that $A_w$ is some mean value between $A_1$ and $A_2$.

In prior art tube within a tube within a tube (tricentric) heat exchangers where heat is transferred between two fluids separated by a double wall and a gap, the value of UA is set by:

$$UA = \frac{1}{\frac{1}{h_1A_1} + \left(\frac{t_a}{k_aA_a} + \frac{t_g}{k_gA_g} + \frac{t_b}{k_bA_b}\right) + \frac{1}{h_2A_2}} \tag{3}$$

where:

h, k, A and t are the same as above and the subscripts are:

1=first fluid side
2=second fluid side
a=inside tube
b=middle tube
g=gap

It is understood that $A_a$ is some mean effective value between the inside and outside areas of the inside tube, $A_b$ is some mean effective value between the inside and outside areas of the middle tube, and that $A_g$ is some mean effective value between the outside area of the inside tube and the inside area of the middle tube.

In the heat exchanger of this application, the value of UA is set by:

$$UA = \frac{1}{\frac{1}{h_1A_1N_1} + \left(\frac{t_a}{k_aA_a} + \frac{t_b}{k_bA_b}\right) + \frac{1}{h_2A_2N_2}} \tag{4}$$

where:

h, k, A and t are the same as above
N=total fin efficiency (dimensionless)

and the subscripts are:

1=first fluid side
2=second fluid side
a=first tube
b=second tube

It is understood that $A_a$ and $A_b$ are equal with the value of each being the mean contact area between the tubes.

Because the entire outside circumference of each of the tubes of the heat exchanger of this application is not in contact with the outside circumference of the other tube, it will be seen that, in the noncontacting portions of each tube, the heat must be conducted circumferentially within a portion of the tube wall. This phenomena corresponds to the case of a fin attached to a heat conducting wall. For ease of reference, the above noted effect in the heat exchanger of this application is called the fin efficiency N. The fin efficiency N is dimensionless since it depends on a non-dimensional parameter and can be expressed for the non-contacting portion of each tube by:

$$N_f = \frac{\tanh\left(\sqrt{\frac{h}{kt}}\,[TC - CC + t/2]\right)}{\sqrt{\frac{h}{kt}}\,(TC - CC + t/2)} \tag{5}$$

where:

$N_f$=fin efficiency of fin portion of tube (dimensionless)
tanh=hyperbolic tangent
TC=Total tube circumference (ft.)
CC=Tube circumferential contact (ft.)
h=convective heat transfer coefficient (Btu./hr.ft.$^2$F)
k=tube wall thermal conductivity (Btu./hr.ft.$^2$F.)
t=tube wall thickness (ft.)

However, because only the non-contacting portion of the tube acts as a fin, the fin efficiency $N_f$ must be weighted with the 100% efficiency of the contact portion of the tube. This can be expressed by:

$$N = \frac{TC - (TC - CC)(1 - N_f)}{TC} \tag{5a}$$

where:

the above symbols apply and
N=total weighted fin efficiency (dimensionless).

Because the total material volume used in a heat exchanger is one significant determinant in the cost of the heat exchanger, a comparison of the value UA for different heat exchangers at the same material volume C is a good indication of the heat exchanger merit.

For a conventional bicentric heat exchanger, the material volume is expressed by:

$$C=P_1t_1L_1+P_2t_2L_2 \quad (6)$$

where:

C=total material volume (ft.$^3$)
P=mean cross-sectional periphery (ft.)
t=tube wall thickness (ft.)
L=tube length (ft.)

and the subscripts are:

1=inside tube
2=outside tube

For the prior art tricentric heat exchanger, the material volume is expressed by:

$$C=P_1t_1L_1+P_2t_2L_2+P_3t_3L_3 \quad (7)$$

where:

C, P, t and L are the same as above and the subscripts are:

1=inside tube
2=middle tube
3=outside tube

For the heat exchanger of this application, the material volume is expressed by:

$$C=P_1t_1L_1+P_2t_2L_2 \quad (8)$$

where:

C, P, t and L are the same as above and the subscripts are:

1=first tube
2=second tube

A comparison can now be made between the value UA of the various heat exchangers at different ratios between the heat transfer coefficients $h_1$ and $h_2$.

A reasonable comparison can be made between the heat exchanger of this application and a conventional bicentric heat exchanger where the pressure drop in both is the same. Assuming the peripheries $P_1$ and $P_2$ are such that the pressure drop is the same for both a conventional bicentric heat exchanger and the heat exchanger of this application, Table I shows a comparison of the value UA where $UA_x$ is for the heat exchanger of this application and $UA_B$ is for the conventional bicentric heat exchanger. It will thus be seen that, surprisingly, the double wall heat exchanger of this application is virtually as good as or better than that of a conventional bicentric heat exchanger.

A reasonable comparison can be made between the heat exchanger of this application and a prior art tricentric heat exchanger where the pressure drop in both are the same. Assuming the peripheries $P_1$ and $P_2$ are such that the pressure drop is the same for both a prior art tricentric heat exchanger and the heat exchanger of this application, Table II shows a comparison of the value UA where $UA_x$ is for the heat exchanger of this application and $UA_T$ is of a prior art tricentric heat exchanger. Table II makes a comparison both without consideration of the gap between the inside tube and middle tube as well as with the consideration of a typical gap in such tricentric heat exchangers where the gap is filled with a heat conducting fluid such as water. Not only is the heat exchanger of this application significantly better than that of a tricentric heat exchanger even if the gap could be eliminated, it is vastly better than such a heat exchanger with a typical gap.

Because the cost of the material used in a heat exchanger is a significant part of the cost of manufacture thereof, it is desirable to minimize the amount of material used to produce a given value UA in the heat exchanger. For the heat exchanger of this application, the material volume C is given in equation (8). The thermal resistance R is primarily controlled by the heat transfer between the fluids and the tube walls. Therefore, the relationship between amount of material and thermal resistance can be closely approximated by:

$$R=\frac{1}{UA}=\frac{1}{h_1P_1L}+\frac{1}{h_2P_2L} \quad (9)$$

where:

R=thermal resistance (hr.F./Btu)
h=convective heat transfer coefficient (Btu/hr.ft.$^2$F.)
P=cross-sectional heat transfer periphery (ft.)
L=length of tubes in contact (ft.)

and the subscripts are:

1=first tube
2=second tube

When both tubes have a common thickness and length as is usually the case, the cross-sectional heat transfer periphery $P_2$ of the second tube can be expressed in terms of cross-sectional heat transfer periphery $P_1$ of the first tube by:

$$P_2=\frac{C}{tL}-P_1 \quad (10)$$

Figure 5:
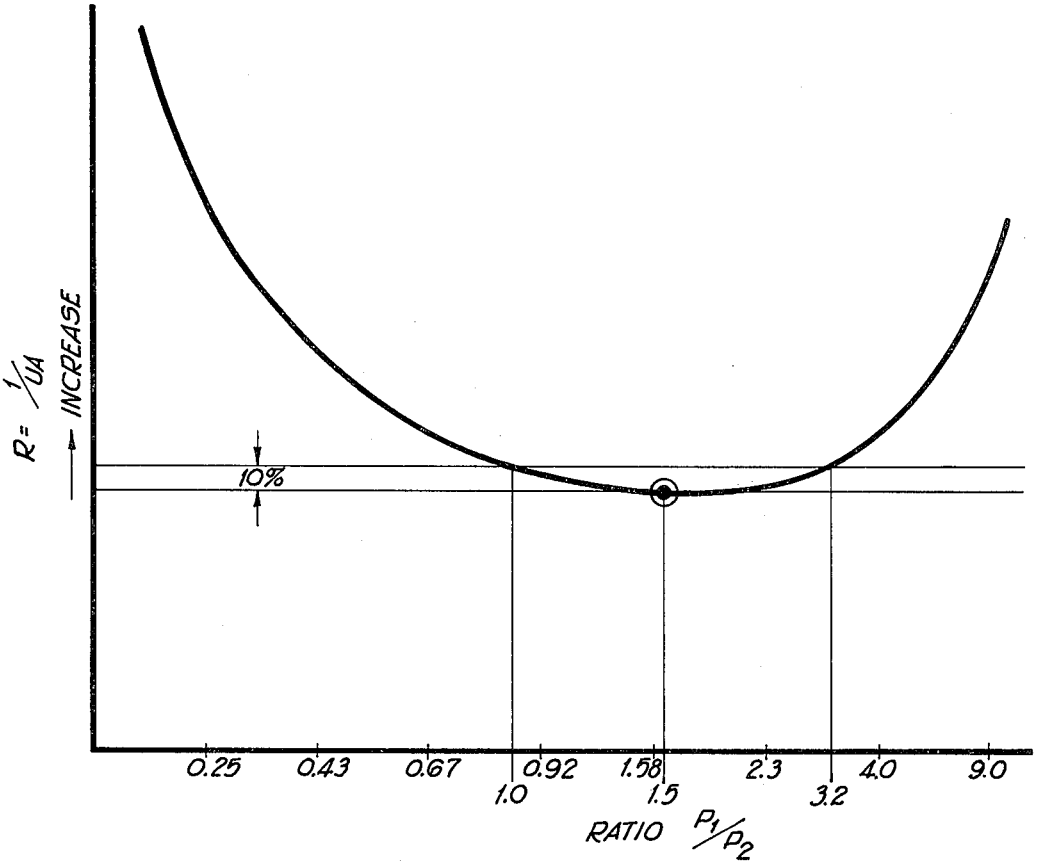
FIG. 5 is a chart showing the heat resistance versus relative fluid-to-surface contact areas.

Then by substituting the equivalent value of $P_2$ in equation (9), one can vary the value of $P_1$ with an appropriate change in $P_2$ to determine a minimum value of R. This allows the thermal resistance R to be plotted against the ratio $P_1/P_2$. FIG. 5 shows such a curve. The minimum value of R occurs when $$\frac{P_1}{P_2}=\sqrt{\frac{h_2}{h_1}} \quad (11)$$

Thus, the minimum amount of material is used when the above ratio is relatively closely maintained.

Design Process

To determine the size and configuration of the heat exchanger of this application, the value of the convective heat transfer coefficient h needs to be determined as well as the pressure drop Δp in the liquid flowing through the heat exchanger. Since both h and Δp are a function of fluid velocity, a trade off between an optimal h and an optimal Δp can be made by varying the velocity of the fluid. This can be accomplished using procedures available to those skilled in the art. While the acceptable value of h will be different for different fluids and the acceptable value of Δp will depend on the pumping circuit available, the following design process is based on the first fluid being condensing refrigerant R-22 and the second fluid being water where heat is transferred from the refrigerant to the water. It will be understood that a similar design process would be used for different fluids and pumping configurations.

Using the specific fluids mentioned above, it has been determined that, in certain applications, optimal heat transfer coefficient values are about 400 Btu/hr.ft.$^2$F. for $h_1$ and about 1000 Btu/hr.ft.$^2$F. for $h_2$ with optimal pressure drops of about 10 psi for $\Delta p_1$ and about 4 psi for $\Delta p_2$. This establishes the cross-sectional flow area FA of each fluid at $FA_1 = 0.072$ in.$^2$ and $FA_2 = 0.144$ in.$^2$. Thus, because separate tubes are used for the two fluids, the cross-sectional flow area of each can be independently adjusted as will become more apparent.

On the other hand, the fluid contacting surface area A also plays a significant role in the rate of heat transfer between the fluids as noted in equation (4). From equation (11), it is noted that the optimum use of tube material is achieved when a mean cross-sectional periphery ratio is reached that is related to the heat transfer coefficient ratio. Using the above coefficients, it will be seen that the optimum surface ratio $P_1/P_2$ is 1.58. Also, it will be appreciated that about a 10% change in thermal resistance can be tolerated within general design determinations. Referring to FIG. 5, it will be seen that, when a 10% change in thermal resistance is applied to the curve of FIG. 5, a ratio range for $P_1/P_2$ of 0.92–3.2 is acceptable. As will become more apparent, the cross-sectional periphery ratios used in the heat exchanger of this application can be related to the tube diameter when the tubes have a circular cross-section. Thus, the diameter ratio of the tubes should have the same ratio as the fluid contact surface areas.

A tube, of course, has its maximum internal passage cross-sectional flow area FA when the tube is in a circular configuration. Therefore, the internal diameter of a circular cross-sectional tube must be at least sufficiently large to produce the cross-sectional flow area FA required for the particular fluid flowing through the tube. In the instances of this example, circular inside diameter $D_1$ of the tube carrying the refrigerant must be at least 0.30 in. and the circular inside diameter $D_2$ of the tube carrying the water must be at least 0.43 in. The cross-sectional flow area of a tube can also be reduced simply by deforming the tube inwardly away from its circular condition. Thus, if the actual circular inside diameter D of the tube exceeds the minimum required circular inside diameter, then the desired cross-sectional flow area can be achieved by inwardly deforming the tube. This is how the desired cross-sectional flow area is achieved in the tubes of the heat exchanger of this application as will become more apparent.

With these criteria in mind, the circular inside diameters of the tubes can be selected. From a manufacturing tolerance standpoint, it is typically desired that the tube be deformed so that the final cross-sectional flow area is not less than about one-third of the circular cross-sectional flow area. As a result of this constraint, it will be seen that the refrigerant circular inside diameter $D_1$ should be about 0.30–0.52 inch while the water circular inside diameter $D_2$ should be about 0.43–0.74 inch with the ratio $D_1/D_2$ about 0.92–3.2.

The contacting portions of the tubes play a significant role in the overall thermal resistance of the heat exchanger since the greater the contact area, the lower the thermal resistance. Because the amount of contact between the tubes is dependent on the diameter ratio between the tubes and the relative amounts of deformation of the tubes, this constraint must be considered in the final selection of the tube circular inside diameters. It has been found that the contact area should be at least about one-fourth of the mean cross-sectional periphery of the tube to get reasonably low thermal resistance. On the other hand, it is difficult to reasonably achieve a contact area of more than about one-half of the mean cross-sectional periphery of the tube. This feature is typically empirically determined.

Also, from a fabrication standpoint, it is generally desirable that the circular inside diameters of the tubes be as nearly equal as possible as will become more apparent. Based on all of the above criteria, a reasonable selection is commercially available —$\frac{3}{8}$–$\frac{1}{2}$ in. OD tubing with a 0.024 in. wall thickness for the refrigerant tubing, and a $\frac{1}{2}$–$\frac{5}{8}$ in. OD tubing with a 0.024 in. wall thickness for the water tubing. It will thus be seen that, if the diameters are to be the same, then the $\frac{1}{2}$ in. tubing is the most reasonable. It will thus be seen that, when deformation is finished, the water tube must be deformed such that the final cross-sectional flow area is reduced 10% from its original circular area while the refrigerant tube must be deformed such that the final cross-sectional flow area is reduced 55% from its original circular area.

The fin efficiency is determined by equations (5) and (5a). Using the above noted $\frac{1}{2}$ in. tubing, the tubes are in contact for about 32% of the tube circumference. This yields a total fin efficiency N of about 68% for the refrigerant tube and about 57% for the water tube.

While length is initially considered in determining the optimal pressure drop $\Delta p$, the final determination of the length of the tubes can now be made. The application to which the heat exchanger is to be put determines the required overall heat transfer rate Q in Btu.hr.F. In this application, as in most of the other heat exchangers, both tube lengths are about the same. This allows equation (4) to be solved for the length L since the other values are known.

HEAT EXCHANGER MANUFACTURE

Using the above criteria, the parameters of the finished heat exchanger of this application can be established. The basic problems that still remain in addition to the manufacturing cost efficiency are: how to maintain the tubes in heat transfer contact with each other and how to affect the desired tube deformation. This may be done in a variety of ways.

To maintain the tubes in heat transfer contact with each other, the tubes in the finished heat exchanger must be urged toward each other. Also, it is easier to control tube deformation by expanding rather than collapsing the tube. One of the easier ways to affect such expansion is to internally pressurize the tube. From a cost standpoint, it is preferable to affect both the urging of the tubes together and the deformation of the tubes in the minimum number of steps with each of the steps being done at a minimum cost.

One of the most practical ways to affect this operation is to wind the tubes into a helical configuration so that the tubes are deformed and operatively associated with each other; and then internally pressurizing the tubes to finally adjust the cross-sectional flow areas of the tubes to the desired size. This procedure is used in the manufacture of the heat exchanger of this application.

Figure 7:
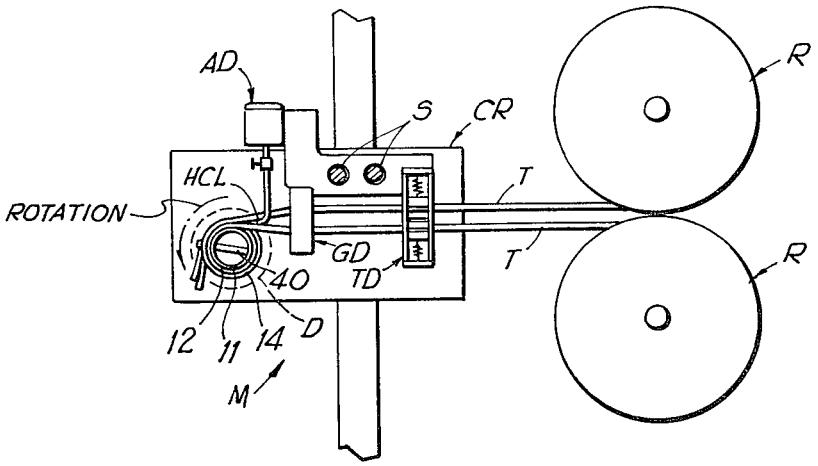
FIG. 7 is a schematic view illustrating the initial step in fabrication of the heat transfer coil of the invention.

The winding set up is illustrated in FIG. 7 of the drawings. To start the winding operation the core 11 is appropriately and removably mounted in a winding machine M provided with a core drive motor D shown in dashed lines to rotate the core 11 in the direction indicated. Two pieces of tubing T are supplied from two supply reels R appropriately mounted for free rotation. The pieces of tubing T are first passed through a tensioning device TD and then through a guide device GD. The workman attaches the ends of the tubing T to the core 11 using J-bolt 40 and starts the drive motor D to rotate the core 11 in the direction shown. It will be noted that the pieces of tubing T are spaced apart as they leave the guide device GD but are forced together at the core 11. A heat conducting liquid HCL is injected between the pieces of tubing T from an applicator device AD just prior to being wrapped around the core 11.

Figure 6:
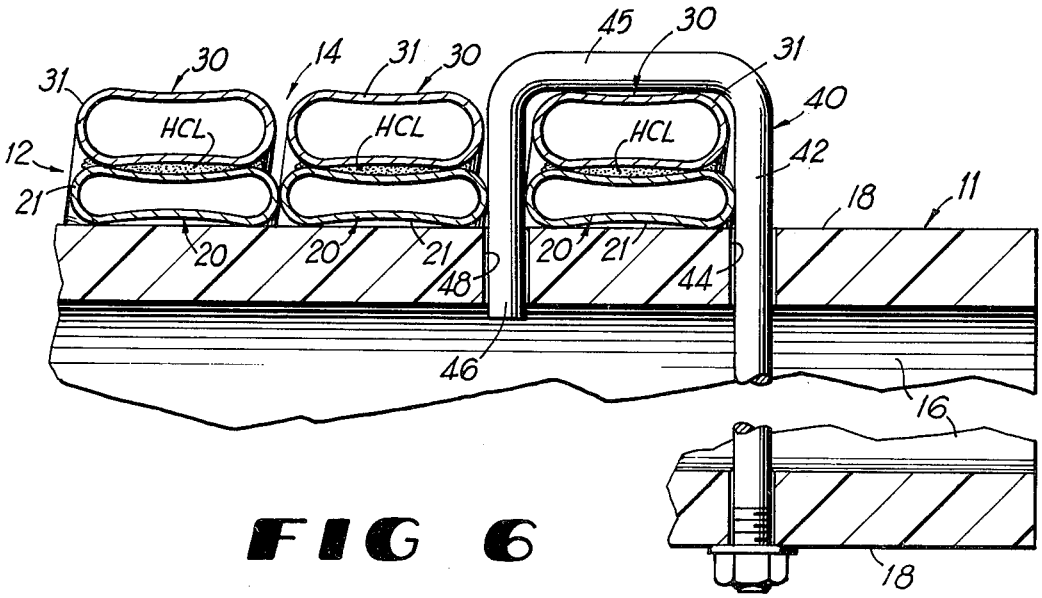
FIG. 6 is an enlarged cross-sectional view similar to FIG. 2 showing the heat transfer coil partially fabricated.

As the core 11 is rotated by motor D, the pieces of tubing T are pulled through the tensioning and guide devices TD and GD and wrapped around core 11. This causes the pieces of tubing T to be deformed to the cross-sectional shapes shown in FIG. 6 and to be wrapped around the core 11 to form the inner and outer coils 12 and 14 with overlying flights 20 and 30 respectively. The diameter of the core 11 and the tension maintained by the tensioning device TD controls the amount of deformation in the tubing. While the amount of deformation may be varied, the deformed cross-sectional flow area of at least one of the pieces of tubing T must be smaller than the desired final cross-sectional flow area and the deformed tubing must be associated so that the deformed cross-sectional flow areas of both of the pieces of tubing T can be finally sized during the internal pressurizing step as will become more apparent. In the wound coil assembly shown in FIG. 6, the inner il 12 is deformed so that its deformed cross-sectional area is considerably less than the desired final ectional flow area whereas the outer coil 14 is d so that its deformed cross-sectional flow area larger than the desired final cross-sectional ing device TD, guide device GD and e AD are mounted on a carriage CR on supports S so that, as the flights are core 11, the carriage CR along with the on can shift axially of the core 11. This driven by the tubing as it is wound around the 1.

When the desired lengths of tubing T have been wound around core 11, the workman installs the J-bolt 42 at the other end of the coil assembly and severs the pieces of tubing to complete the winding operation. The wound coil assembly is then removed from the winding machine.

It will be appreciated that the winding operation coldworks the material of the inner and outer coils 12 and 14 as the cross-sectional deformation and bending around the core takes place. As will become more apparent, this is a desirable effect. Also, the tension applied during the winding operation usually generates further coldworking by elongation of the tubing as it is being wound, especially where the tubing is ductile before the winding operation. This allows copper or copper alloy tubing in its softest state to be used to facilitate the winding operation as will become more apparent.

The coil assembly is now ready for the pressurization operation to achieve the desired cross-sectional flow areas in the coils 12 and 14 and also force the coils into heat transfer contact with each other. The pressurization operation is illustrated in FIG. 8.

Figure 8:
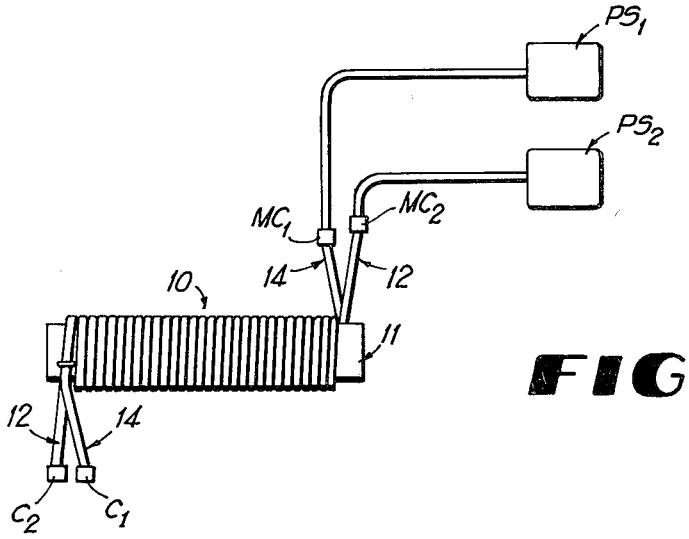
FIG. 8 is a schematic view showing the fabrication of the heat transfer coil of the invention being completed.

One end of each of the coils 12 and 14 are closed with echanical closing devices $C_1$ and $C_2$ while the opposite ends of the coils are connected to separate pressure sources $PS_1$ and $PS_2$ with mechanical connectors $MC_1$ and $MC_2$ as illustrated in FIG. 8. The use of mechanical connectors rather than soldered or brazed joints is required since the mechanical connectors do not adversely affect the already induced cold-working in the coil whereas the other mentioned connection techniques do. The pressure sources $PS_1$ and $PS_2$ are conventional and can be adjusted to supply different pressures. The pressures are adjusted so that the cross-sectional flow areas are deformed from that shown in FIG. 6 to that shown in FIGS. 2 and 3. In this particular instance, the inner coil 12 is expanded so that the outer coil 14 is further collapsed and the tube wall sections 28 and 36 of coils 12 and 14 are forced into heat transfer contact with each other. The heat conducting liquid HCL facilitates this process since it acts as a lubricant to permit the tube wall sections 28 and 36 to slide with respect to each other during pressurization. Additionally, the heat conducting liquid fills in any surface irregularities between the tube wall sections 28 and 36 to promote heat transfer and to prevent an oxide layer from forming between the tubes. The excess heat transfer liquid is squeezed out from between the tube wall sections 28 and 36, but remains in heat conducting contact with the tube walls 21 and 31 to enhance the heat transfer between the coils. While different heat conducting liquids HCL may be used, a material commercially sold as thermal mastic by Virginia Chemical Co. has proved satisfactory.

The exact amount of pressure imposed in each of the coils is emperically determined to get the desired final cross-sectional flow areas. For copper tubing in its fully annealed condition, it has been found that a pressure of about 2500 psi for the water coil 12 and a pressure of about 650 psi for the refrigerant coil 14 is adequate. Sometimes, it is desirable to use cuprous nickel tubing for water coil 12, especially where corrosive water is encountered. When this stronger material is used, a pressure of about 3000 psi is required to form the water coil 12 with the same pressure used in the refrigerant coil 14.

It will also be appreciated that, while both pressures are illustrated as being simultaneously applied, the pressures may be sequentially applied. Usually, the higher pressure is applied first followed by the lower pressure. It will likewise be appreciated that the pressures applied must be at least as great as the working pressures to which the coils are to be subjected so that no deformation of the coils is encountered during operation. In the particular example given, the refrigerant pressurization pressure is about 1.5 times as great as the working pressure while the water pressurization pressure is about 38 times as great as the typical working pressure.

It will also be seen that the core 11 acts as a base to control the direction of expansion of the water coil 12 while the J-bolts 40 captivate the coils 12 and 14 to prevent them from uncoiling during the pressurization step. The pressurization, by deforming the cross-sectional shape of the coils, also further coldworks the coils. Thus, portions of the tube walls in the coils are expanded beyond their elastic limits to cause a portion of the total deformation to become permanent after the deformation pressure is removed. At the same time, however, the elasticity of the tube walls serves to force the walls back toward their initially deformed state. The result of this action is that the tube wall sections 28 and 36 remain tightly forced together to maintain good heat transfer contact therebetween after the deformation pressures are removed.

OPERATION

Referring to FIGS. 1-3, it will be seen that the heat exchanger of this application is designed for use as a condenser with condensing refrigerant flowing through the outer coil 14 so that heat is transferred from the refrigerant to the water flowing through the inner coil 12. There is a change of phase in the refrigerant but not in the water. Because there is a change of phase from vapor to liquid, there is a significant advantage in flowing the refrigerant through the outer coil 14. This is because the centrifugal forces on the condensing refrigerant causes the heavier liquid phase to be forced toward the outboard section 38 of tube wall 31 of coil 14 while the vapor phase is forced toward the inboard section 36. The primary heat exchange mechanism in the refrigerant occurs when the refrigerant vapor condenses to a liquid. Thus, because better heat transfer to the water occurs where the tube walls are in contact, keeping the vapor in contact with the inboard wall section 36 enhances the heat transfer rate. While the effect is not as pronounced in the inner water coil 12, it will likewise be appreciated that the colder water, being more dense, is forced toward the outboard tube wall section 28 of coil 12 while the hotter water is forced toward the inboard tube wall section 26 of coil 12. When the heat exchanger is used as an evaporator, the fluids in the tubes are interchanged.

Observation of the above phenomena allows one to generalize the fluid relationships in the coil assembly 10. To get the maximum potential heat transfer benefit from the centrifugal forces in the coil assembly 10, one should design the assembly so that the colder fluid moves through the inner coil 12 while the hotter fluid moves through the outer coil 14.

ALTERNATE PRESSURIZATION PROCEDURE

It will also be appreciated that the cross-sectional flow area of either or both of the coils 12 and 14 may be varied from one end to the other. This may be desirable when there is a change in phase in the heat transfer fluid as it passes through the coil 12 or 14 in order to maintain a relatively constant velocity. For example, in the coil assembly 10 illustrated, the refrigerant in coil 14 condenses from a gas to a liquid as it passes from the inlet end, for instance 34, to the outlet end, for instance 35. To maintain a relatively constant velocity, it would be desirable to vary the cross-sectional flow area of coil 14 from end 34 to end 35 to compensate for the reduction in refrigerant volume due to condensation. In other words, coil 14 should taper from end 34 to end 35 with end 34 being larger.

Figure 9:
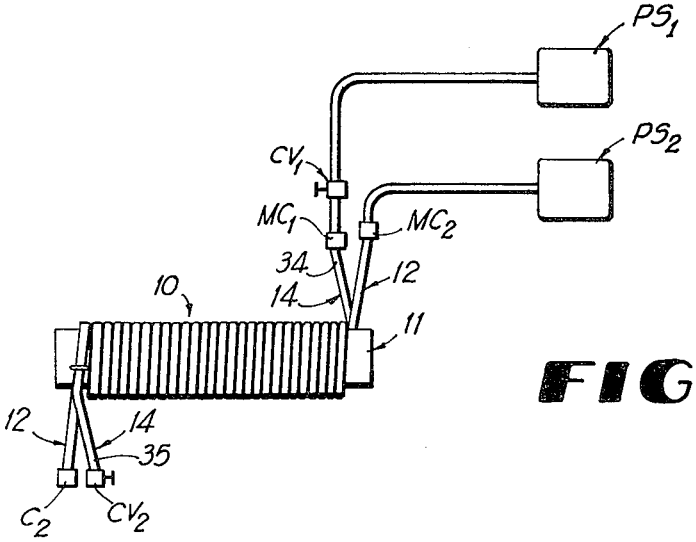
FIG. 9 is a schematic view similar to FIG. 8 showing an alternate method for completing the fabrication of the heat transfer coil.

The tapering of coil 14 can be accomplished as illustrated in FIG. 9 by connecting coil 12 the same as coil 14 in the earlier described method. The end 34 of coil 14, however, would be connected to source $PS_1$ through flow control valve $CV_1$ while the end 35 of coil 14 would be connected to a second flow control valve $CV_2$. Source $PS_1$ would pump a fluid such that, by regulating valves $CV_1$ and $CV_2$, the required pressure variation can be imposed along coil 14 to vary the cross-sectional flow area as desired.

ALTERNATE COIL CONFIGURATION

Figure 4:
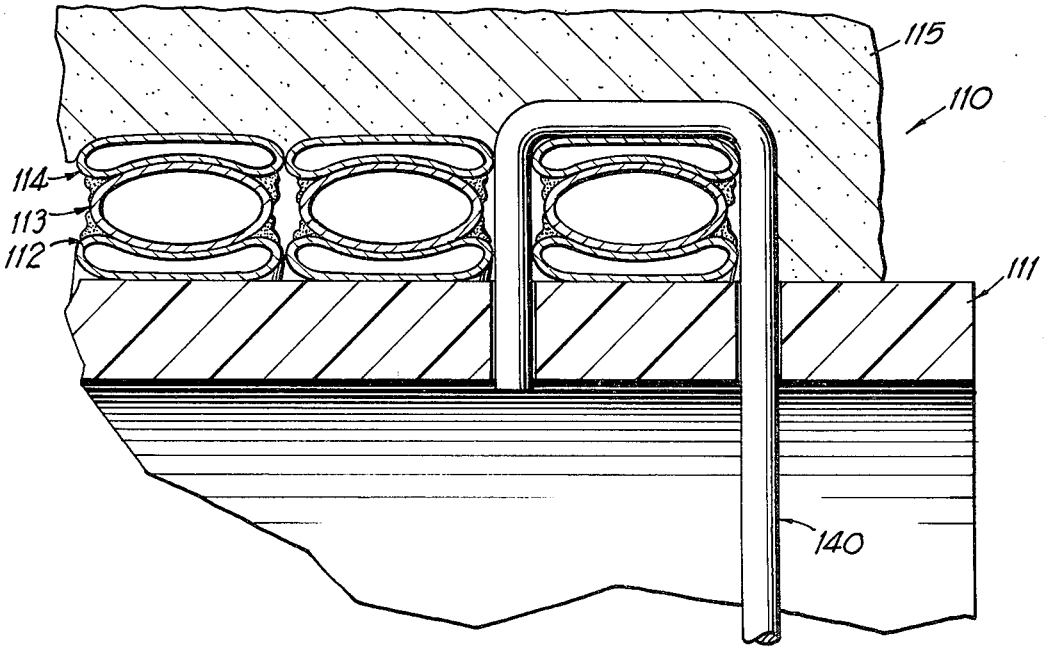
FIG. 4 is an enlarged cross-sectional view similar to FIG. 2 showing an alternate embodiment of the heat transfer coil.

The heat exchanger construction of this application is not limited to two coils. An alternate configuration is shown in FIG. 4 and designated coil assembly 110 with three coils 112, 113 and 114 mounted on core 111. The design and fabrication of this coil assembly 110 would correspond to that of the first configuration. Thus, it will be seen that any practical number of coils may be utilized.

TABLE I

Comparison between heat exchangers with equal material volume and equal pressure drop:

| $\frac{h_1}{h_2}$ | $\frac{UA_x}{UA_B}$ |
|---|---|
| .1 | 1.19 |
| .2 | 1.08 |
| .5 | .97 |
| 1.0 | .94 |
| 1.5 | .95 |
| 2.0 | .97 |
| 5.0 | 1.08 |

TABLE II

Comparison between heat exchangers with equal material volume and equal pressure drop:

| $\frac{h_1}{h_2}$ | $\frac{UA_x}{UA_T}$ without gap | with gap |
|---|---|---|
| 0.1 | 1.8 | 22.5 |
| 0.2 | 1.63 | 20.4 |
| 0.5 | 1.46 | 18.3 |
| 1.0 | 1.41 | 17.6 |
| 1.5 | 1.43 | 17.9 |
| 2.0 | 1.46 | 18.3 |
| 5.0 | 1.63 | 20.4 |
| 10.0 | 1.8 | 22.5 |

What is claimed as invention is:

1. A heat transfer coil for use with heat transfer fluids between which heat is to be transferred comprising:

a first piece of heat conductive tubing wound in a helical configuration defining a plurality of first helical flights having an outboard portion thereon; and a second piece of heat conductive tubing wound in a helical configuration defining a plurality of second helical flights having an inboard portion thereon, said first and second helical flights arranged so that said outboard portion of said first helical flights is aligned with and in conforming intimate physical contact with said inboard portion of said second helical flights, each of said first and second pieces of tubing defining a fluid passage therethrough whose cross-sectional areas have been adjusted by internally pressurizing said pieces of tubing to non-elastically deform both of said pieces of tubing to change the cross-sectional area of said passage through each of said pieces of tubing to a desired final size while maintaining intimate physical contact between said first and second helical flights.

2. A heat transfer coil for use with heat transfer fluids between which heat to be transferred comprising:

a core member defining an outer cylindrical surface thereon;

a first piece of heat conductive tubing defining a passage therethrough having a first prescribed cross-sectional area, said first piece of tubing wound around said core member and defining a plurality of first helical flights having an inboard portion thereon supported on the outer cylindrical surface of said core member and an outboard portion thereon;

a second piece of heat conductive tubing defining a passage therethrough having a second prescribed cross-sectional area, said second piece of tubing wound around said first piece of tubing and defining a plurality of second helical flights overlying said first helical flights and having an inboard portion thereon in physical contact with said outboard portion of said first helical flights, said first and second helical flights having been formed by winding said first piece of tubing around said core member and winding said second piece of tubing around said first piece of tubing so that both said pieces of tubing have a deformed non-circular cross-sectional shape with said passage through at least one of said pieces of tubing having an initial cross-sectional area smaller than said prescribed cross-sectional area and then internally pressurizing said pieces of tubing to force said outboard portion of said first helical flights and said inboard portion of said second helical flights into physical contact with each other while changing the cross-sectional areas of said passages through both pieces of tubing until said passage through said first piece of tubing has said first prescribed cross-sectional area and said passage through said second piece of tubing has said second prescribed cross-sectional area.

3. The heat transfer coil of claim 2 wherein said core member is made of an insulating material and further including an insulating covering enclosing said first and second helical flights between said covering and said core member so that the heat is transferred between the heat transfer fluids through said pieces of tubing.

4. The heat transfer coil of claim 2 further including a flowable heat conducting material between said outboard portion of said first helical flights and said inboard portion of said second helical flights.

5. The heat transfer coil of claim 2 further including first clamping means clamping said first and second helical flights at one end of the coil to said core member and second clamping means for clamping said first and second helical flights at the opposite end of the coil to said core member to maintain said first and second pieces of tubing in said helical configuration.

6. The heat transfer coil of claim 5 wherein each of said clamping means comprises a J-bolt including a shank portion extending through said core member and adjacent one side of said first and second helical flights clamped by said bolt, a hook end portion integral with said shank portion and extending around said second helical flight, and a tip portion integral with said hook end portion extending adjacent the opposite side of said first and second helical flights clamped by said bolt and through said core member so that said first and second helical flights clamped by said bolt are confined between said bolt and said core member; and means for tightening said bolt to clamp said first and second helical flights.

7. The heat transfer coil of claim 2 wherein said second helical flights have an outboard portion thereon and further including a third piece of heat conductive tubing defining a passage therethrough having a third prescribed cross-sectional area, said third piece of tubing wound around said second piece of tubing and defining a plurality of third helical flights overlying said second helical flights and having an inboard portion thereon in physical contact with said outboard portion of said second helical flights, said third helical flights having been formed by winding said third piece of tubing around said second piece of tubing prior to pressurizing said pieces of tubing so that pressurizing said pieces of tubing forces said outboard portion of said second helical flights and said inboard portion of said third helical flights into physical contact with each other while changing the cross-sectional area of said passage through said third piece of tubing until said passage through said third piece of tubing has said third prescribed cross-sectional area.

8. The heat transfer coil of claim 2 for transferring heat between a first fluid flowing through said passage in said first piece of tubing and a second fluid flowing through said passage in said second piece of tubing wherein the ratio of the inside cross-sectional peripheral surface of said first piece of tubing to the inside cross-sectional peripheral surface of said second piece of tubing is approximately the square root of the ratio of the convective heat transfer coefficient of the second fluid with said second piece of tubing to the convective heat transfer coefficient of the first fluid with said first piece of tubing.

* * * * *